United States Patent [19]

Ozaki

[11] Patent Number: 4,734,985

[45] Date of Patent: Apr. 5, 1988

[54] PORTABLE CAN OPENER

[75] Inventor: Osamu Ozaki, Komaki, Japan

[73] Assignee: Sanyei Corporation, Japan

[21] Appl. No.: 7,524

[22] Filed: Jan. 28, 1987

[51] Int. Cl.[4] ..... B67B 7/38

[52] U.S. Cl. ..... 30/404; 30/405

[58] Field of Search ..... 30/404, 403, 405, 401, 30/419, 420, 421

[56] References Cited

U.S. PATENT DOCUMENTS

| | | | |
|---|---|---|---|
| 2,883,745 | 4/1959 | Bristol | 30/401 |
| 3,733,698 | 5/1973 | Yamamoto | 30/404 |
| 3,791,029 | 2/1974 | Yamamoto | 30/404 |
| 3,994,063 | 11/1976 | McLean | 30/403 |
| 4,561,182 | 12/1985 | Yamamoto et al. | 30/433 |

*Primary Examiner*—Douglas D. Watts

*Attorney, Agent, or Firm*—Ostrolenk, Faber, Gerb & Soffen

[57] ABSTRACT

A battery powered can opener includes a cutter assembly that is pivotally mounted at the front of a housing for a motor, batteries for powering same, a speed reducing gear train and a switch for controlling energization of the motor. The clutch assembly is movable to a position for retaining the opener on the bead of a can whose top is to be severed. After mounting of the opener on a can, a manually operated switch control remote from the cutter is operated to start the motor which acts through the gear train to drive the opener around the bead. As the motor starts, a wedging action between the can cover and the blade of the cutter assembly causes the latter to pierce the can top, and continued energization of the motor results in the blade cutting the top along the bead. Cutting results in the production of a reaction force that acts through the cutter assembly and a latch to hold the motor energizing switch closed after the switch control is released. When the can top is completely severed from the can body, the reaction force terminates and the latch releases the switch control to deenergize the motor automatically.

9 Claims, 5 Drawing Sheets

FIG. 6
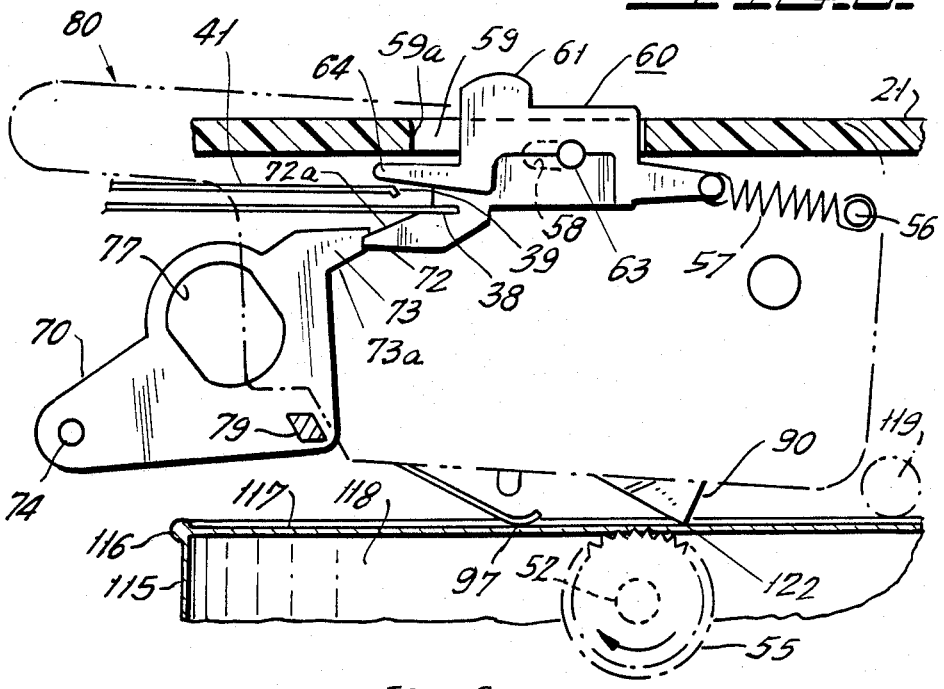
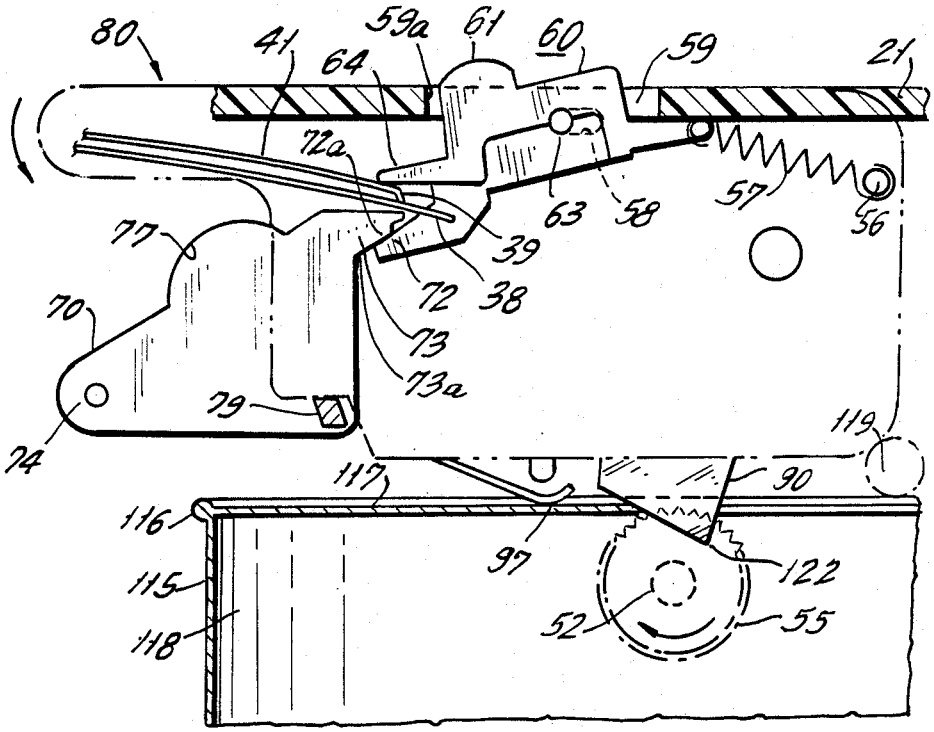
FIG. 7

PORTABLE CAN OPENER

BACKGROUND OF THE INVENTION

This invention relates to electric can openers in general and more particularly relates to a battery powered automatic can opener.

As explained in the T. R. Meyer and R. W. Arel, U.S. Pat. No. 3,550,271, issued Dec. 29, 1974 for an Automatic Can Opener, early constructions for power operated can openers utilized an electric motor to drive a mechanism very similar to that of a hand operated can opener. To utilize such mechanisms, a manual force had to be applied in order to pierce the can lid. In modifications of these early constructions, motor operated can openers provided for power piercing of the can top and also provided for automatically stopping the electric motor when the can top was completely severed from the can body.

Unfortunately, these added features also added complexity to the can opener mechanisms and made them unnecessarily bulky, especially when such can openers were intended to be used with tall cans.

SUMMARY OF THE INVENTION

The instant invention overcomes the foregoing disadvantages of the prior art by providing a battery operated, lightweight, compact can opener having an economical reliable operating mechanism. The can opener of the instant invention provides for power piercing of the can top and provides for automatic shut-off when the can top is severed from the can body.

These last two features are provided by a mechanism which produces a wedging action between a pivoted cutter and the can top. Such wedging action causes the cutter to pierce the can top as soon as the motor is energized, and as long as cutting is taking place there is a reaction force which pivots the cutter assembly so that a portion thereof maintains the motor control switch closed. This reaction force ceases when the can top is completely severed from the can body, and when the reaction force is no longer present the cutter assembly releases the motor control switch so that it is free to open under the control of a biasing means.

To mount the can opener of the instant invention on a can, the cutter assembly is pivoted to an open or dismounting position and is then pivoted to a closed or mounted position wherein a toothed drive wheel engages the lower surface of a bead surrounding the can cover, and the cutter rests against the top of the can, having been forced to a retracted position during engagement with the can top. A switch control mounted remote from the cutter assembly is then operated to start the motor that drives the toothed wheel thereby rotating the can. This rotation is in a direction that generates a wedging action between the can top and the cutter blade causing the pointed tip of the latter to pierce the can top. Continued rotation of the can causes the blade to cut the can top, and while this cutting is in progress there is a reaction force that acts to move the cutter assembly slightly toward the can top to a position in which the cutter assembly operates a latch element to a latching position wherein the latch engages the switch control to hold same in the switch contact closed position. When cutting is completed, the reaction force ceases and the cutter mechanism becomes ineffective to hold the latch in its latching position so that the switch control is released and the switch opens to deenergize the motor.

OBJECTS OF THE INVENTION

Accordingly, the primary object of the instant invention is to provide a novel construction for a battery operated automatic can opener.

Another object is to provide a can opener of this type that is reliable and simple to operate.

Still another object is to provide a can opener of this type that is compact and lightweight.

A further object is to provide a can opener of this type that rides along the upper edge of a can without being supported or guided by the user.

A still further object is to provide a can opener of this type that power pierces the can top, shuts down automatically when cutting is completed, and remains mounted to the can until positively removed.

BRIEF DESCRIPTION OF THE DRAWINGS

These objects, as well as other objects of this invention shall become readily apparent after reading the following description of the accompanying drawings in which:

FIGS. 6 and 7 are rear elevations of the cutter assembly and switch elements. In FIG. 6, the cutter assembly blade is resting against the top of a can prior to energizing the can driving motor, and in FIG. 7 the elements are shown while a can top is being cut.

DETAILED DESCRIPTION OF THE PREFERRED EMBODIMENT

Figure 2:
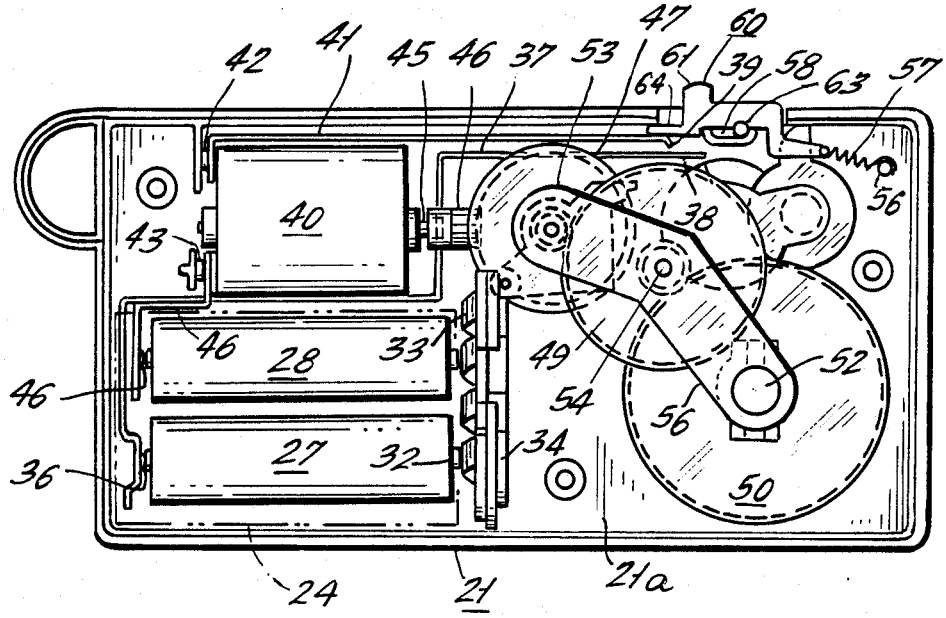
FIG. 2 is a rear elevation of the can opener with the rear cover thereof removed.

Now referring to the Figure. Portable battery-operated automatic can opener 20 includes shallow front and rear plastic housing sections 21, 22 that mate along line 23. Rear housing section 22 is provided with an opening that is normally closed by cover 24 which is shown in phantom in FIG. 2. This rear opening in housing 21, 22 is for the insertion and removal of four size AA batteries 26–29 that are connected in electrical series by conducting straps 31–33, the latter two straps being mounted on insulating plate-like insert 34 that is locked between housing sections 21, 22. The terminal of battery 26 remote from strap 32 is connected to terminal 36 at one end of conducting element 37 whose other end is cantilevered and constitutes a spring-like switch contact 38. The latter is engageable by downturned formation 39 at one end of cantilevered spring contact 41 whose other end is connected to contact 42 of motor 40. The other contact 43 of motor 40 is connected to one end of conducting strap 44 having contact 46 at the other end thereof. The terminal of battery 29 remote from strap 33 engages contact 46. Thus, when elements 38, 39 are in engagement, motor 40 is energized by the series combination of batteries 26–29 causing rotation of motor output shaft 45.

The latter is keyed to spur gear 46 whose teeth are in driving engagement with the peripheral teeth of combination or duplex gear element 47. The teeth on the small diameter section 48 of element 47 are in mesh with the peripheral teeth of combination or duplex gear element 49, and the teeth on the small diameter portion 51 of element 49 are in mesh with the peripheral teeth of output gear 50 that is keyed to shaft 52 at the rear thereof. Gear elements 47, 49 are constructed of plastic and are rotatably mounted on the respective stub shafts 53, 54 that project rearwardly from respective posts 53*a*, 54*a*. The latter extend rearward from front wall 21*a* of front housing section 21. The rear ends of shafts 52, 53, 54 are journaled in apertures of metal dog-leg keeper plate 56. The front of shaft 52 extends through hole 52*a* in wall 21*a* and is keyed to drive-wheel 55 that is disposed adjacent to the front surface of wall 21*a*.

Switch contacts 38, 39 are manually operated into engagement by control 60 having manually engageable section 61 that protrudes upward through opening 59 in the top of housing 21, 22. Control 60 also includes main horizontal section 62 having aligned pin formations 63, 63 extending outward from its longer sides into elongated horizontal guide slots 58 in housing sections 21, 22. The right end of control 60, as viewed in FIGS. 2 and 5–7, is connected to one end of coiled tension spring 57 whose other end is connected to post 56 so that control 60 is biased to the right toward switch OFF position. Plate-like portion 64, at the end of control 60 remote from spring 57, is engageable with the upper surface of switch member 41 in the region of contact number 39. As will hereinafter be seen, as section 61 of control 60 is moved toward end 59*a* of aperture 59, contact 39 engages contact 38 to complete the energizing circuit for motor 40.

Figure 9:
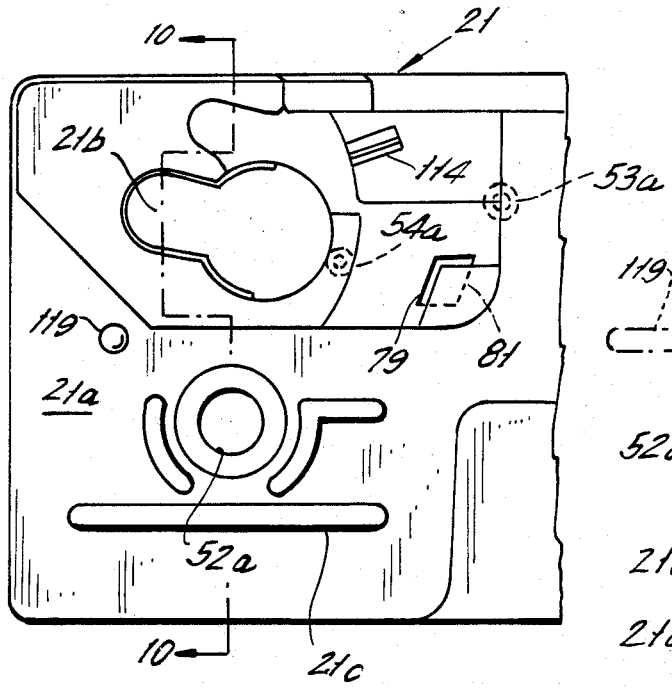
FIG. 9 is a fragmentary front elevation of the front housing section in the region of the mounting for the cutter assembly.
Figure 10:
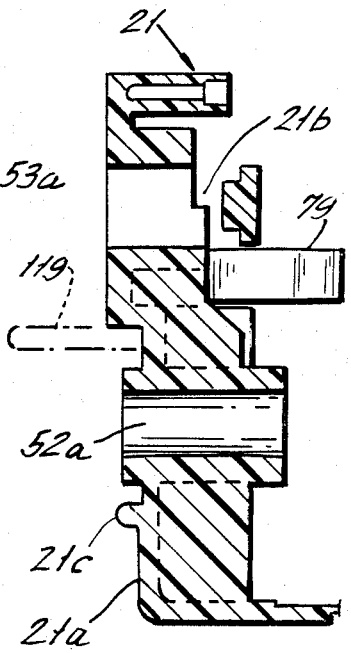
FIG. 10 is a cross-section through line 10—10 of FIG. 9 looking in the direction of arrows 10, 10.

Control 60 also includes extension 71 that protrudes downward from main section 64. As will hereinafter be seen, the free end or latching tip 72 of projection 71 cooperates with latching tip 73 of latch 70 to achieve continuous run and automatic shut-off. Latch 70 is pivotally mounted to front housing section 21, being provided with aperture 74 that receives pin 76 formed integrally with front housing 21 and extending rearward from front wall 21*a*. Post 53*a* extends through elongated slot 77 of latch 70 to limit pivotal movement of the latter about pin 76 as a center. Push nut 78 fits over post 53*a* to retain latch 70 in its operative position. For a reason to be hereinafter explained, latch 70 is also provided with transverse projection 79 that extends forward through aperture 81 (FIG. 9) in front housing wall 21*a*.

Figure 3:
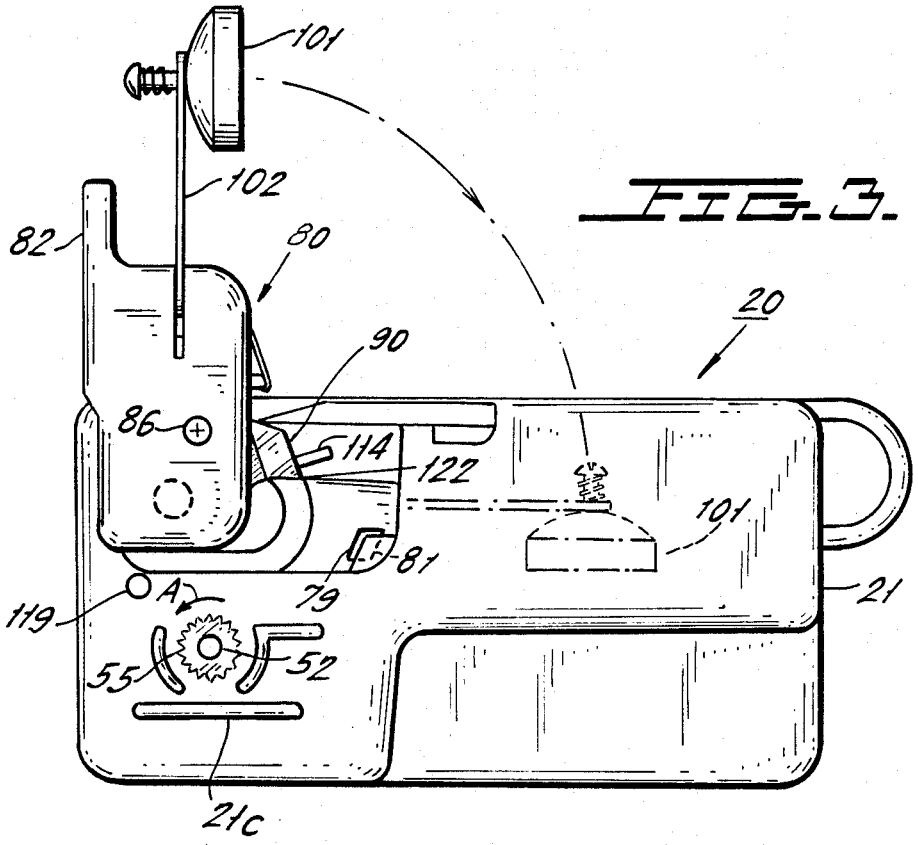
FIG. 3 is a front elevation of the can opener.
Figure 4:
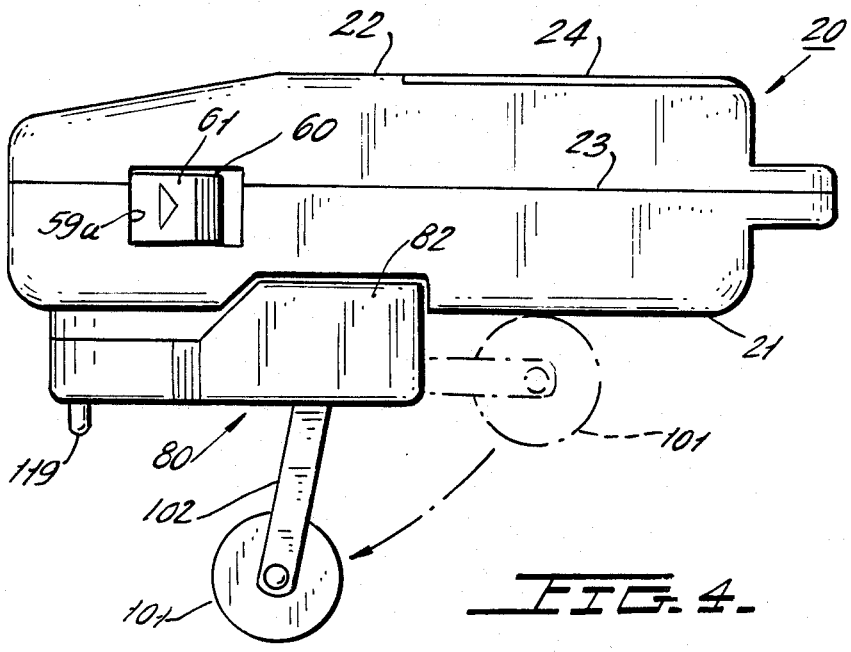
FIG. 4 is a top plan view of the can opener.
Figure 5:
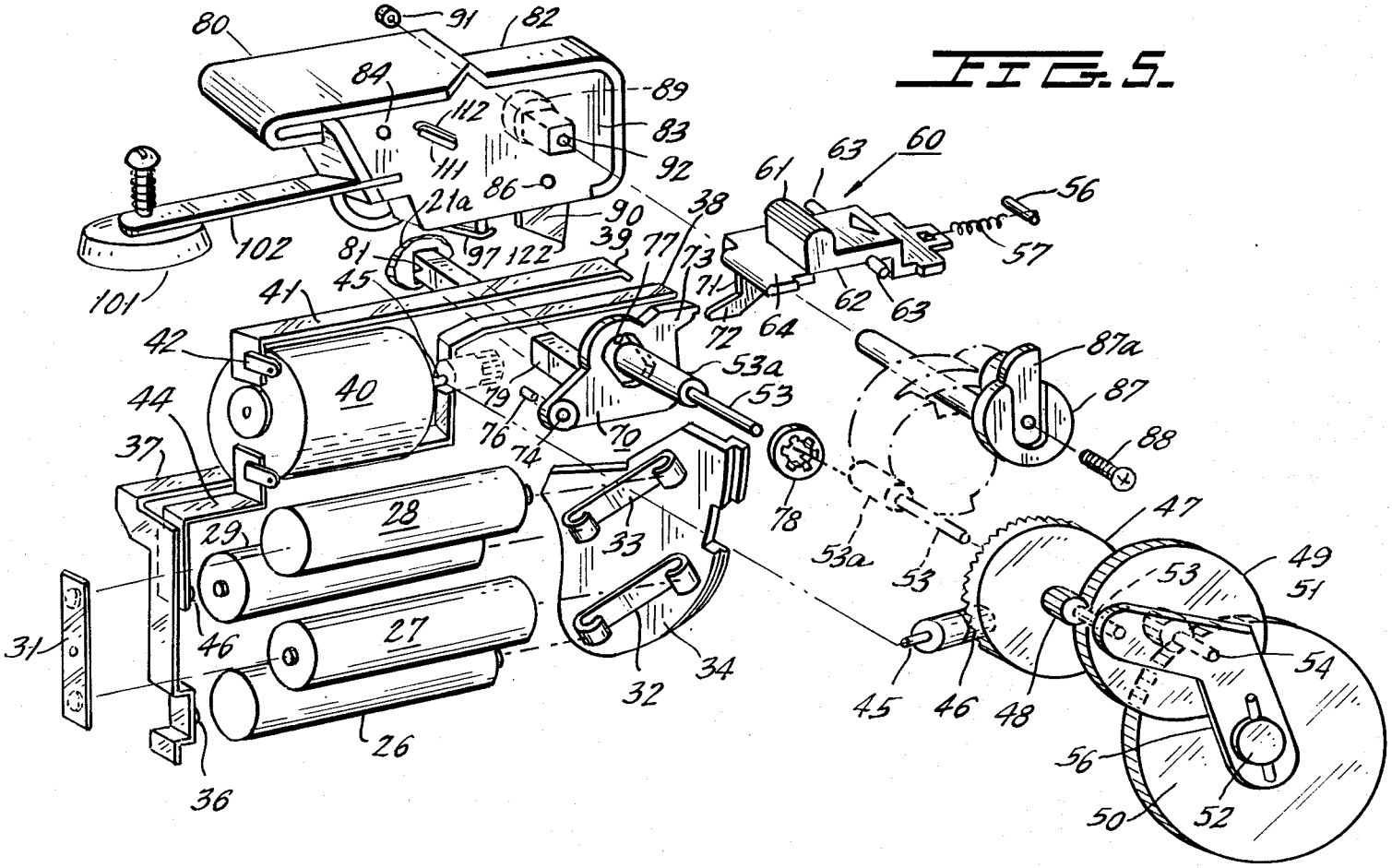
FIG. 5 is an exploded perspective of the main elements of the can opener.
Figure 8:
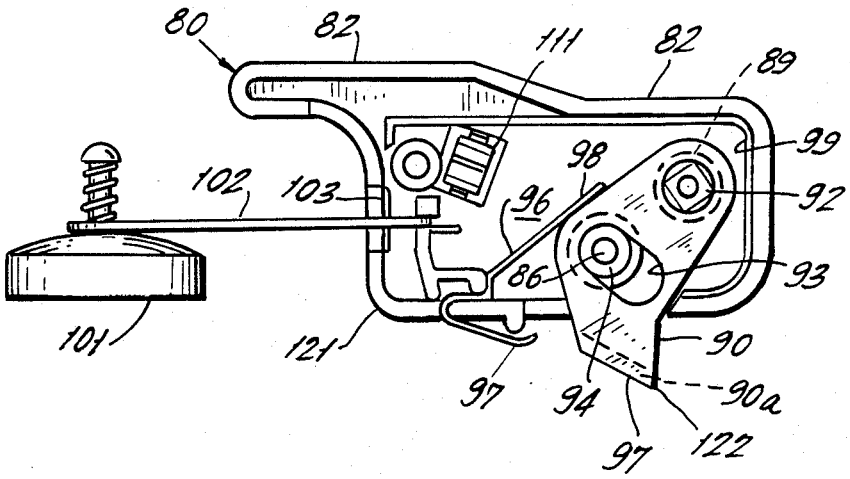
FIG. 8 is a rear elevation of the latter assembly with the rear cover and pivot mounting portions removed.

Cutter assembly 80 shown in FIG. 8 includes molded plastic handle section 82 that defines cavity 99 whose rear open side that is covered by metal plate 83 that is secured in place by rear entered screw 84 and front entered screw 86. Mounting element 87 extends to the rear of plate 83, being secured thereto by screw 88 that extends through a bore in indexing formation 89 and is received by nut 91. The rear section of element 89 is of square cross section and is received by square indexing aperture 92 in plate 83 and a cooperative square indexing depression (not shown) that is open at the front of element 87. The rear 87*a* of element 87 is formed so as to cooperate with keyhole type mounting formation 21*b* (FIG. 9), of a type known to the art, so that when assembly 80 is in the can mounting vertical position of FIG. 3, assembly 80 may slide to the right and then be moved forward to dismount assembly 80 from housing 21, 22, and when assembly 80 is moved clockwise a short distance from the position of FIG. 3 it can no longer be dismounted from housing 21, 22.

Also disposed within cavity 99 is knife type blade 90 that is pivotally mounted on a circular portion of indexing member 89. Elongated slot 93 of blade 90 receives embossment 94 and cooperates therewith to limit pivotal movement of blade 90. The lower or cutting edge 90*a* of blade 90 is disposed outside of cavity 99 at the bottom thereof. Also mounted within cavity 99 is leaf spring 96 having can engaging formation 97 at one end thereof and blade biasing formation 98 at the other end thereof. The latter biases cutting edge 90*a* outward of cavity 99. Cover lifting magnet 101 is mounted to one end of arm 102 whose other end mounts vertical pivot pin 103 that is disposed within cavity 99 so as to permit pivoting movement of arm 102 with respect to handle portion 82.

Also disposed within cavity 99 is a flexible plastic catch that protrudes slightly outside of cavity 99 through slot 112 in plate 83. Catch 111 cooperates with formation 114 to prevent cutter assembly 80 from rotating away from can 115 once assembly 80 is moved to its cutting ready position of FIG. 6. Also protruding forward from front wall 21*a* is can positioning rod 119 that engages bead 116 which secures top cover 117 to body 118 of can 115.

Figure 1:
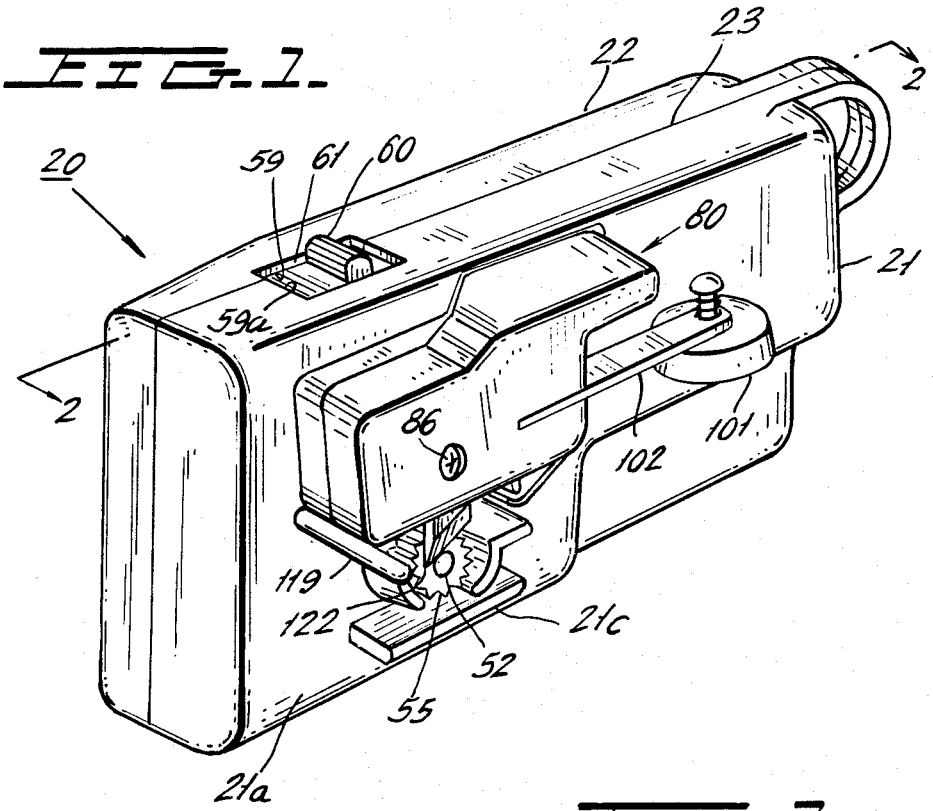
FIG. 1 is a perspective looking toward the front of a battery powered automatic can opener constructed in accordance with teachings of the instant invention.

Can opener 20 is utilized to sever cover 117 from can body 118 by first moving cutter 80 in a counterclockwise or upward direction from its generally horizontal position of FIG. 1, and placing opener 80 so that the periphery of drive wheel 55 engages bead 116 from below, and pin 119 engages the top of bead 116. Assembly 80 is then pivoted clockwise with respect to FIG. 1 to its generally horizontal position of FIG. 6. During this latter operation cutter tip 122 engages can top 117 just inboard of bead 116 without piercing cover 117. This forces blade 90 to pivot clockwise with respect to FIG. 7, thereby partially retracting blade 90. Now spring end 97 rests against the upper surface of can top 117 and the side of can body 118 rests against embossment 21*c* that protrudes forward from wall 21*a*.

At this time, switch contact elements 38, 41 are self biased so they are out of engagement and contact element 41 supports switch control member 60 so that it is in a raised position, with the free end of tip 72 disposed in a notch at the free end of latch nose 73. Catch formation 111 that protrudes from the rear of handle portion 82 of assembly 80 is below cooperating forward protrusion 114 of front housing section 21. The cooperation between formations 111 and 114 limits the movement of assembly toward its raised position of FIG. 3, even through assembly 80 is being urged in this direction by the force of spring section 98 acting against blade 90. Opener 20 is now supported on can 115.

To commence cutting, it is necessary to slide switch control 60 to the left with respect to FIG. 6 to the position of FIG. 7. As this occurs, control formation 64 is forced downward through the cooperation of engaging sloping surfaces 72*a* and 73*a* of the respective latching tips 72, 73. This downward movement of control element portion 64 deflects switch contact elements 38 and 41 downward into engagement, thereby closing the energizing circuit for motor 40, causing drive wheel 55 to rotate in the direction indicated by arrow A in FIG. 3 which in turn causes opener 20 to travel along bead 116. This generates a wedging action that causes blade tip 122 to pierce can top 117. At this point, reaction forces acting on assembly 80 urge it to move in a clockwise direction with respect to FIG. 1 so that corner 121 of cover plate 83 engages protrusion 79 and moves latch member 70 a short distance clockwise from its position of FIG. 6 to its position of FIG. 7. This changes the angle of inclination of latch tip surface 73*a* to a position where biasing spring 57 does not exert a force sufficient to retract control element 60, so that motor 40 remains energized even through control element 60 is released.

So long as motor 40 is energized, rotation of drive wheel 55 moves opener 20 along bead 116 and edge 90*a* of blade 90 cuts can top 117. When top 117 is completely severed, this terminates the reaction force that had been acting to bias assembly 80 in a clockwise direction with respect to FIG. 1. Now the biasing forces of contact elements 38, 41, acting through control 60, are sufficient to pivot latch 70 counterclockwise to its position of FIG. 6. In this position the inclination of latching surface 73*a* relative to surface 72*a* is such that the forces therebetween which act in opposition to the force of spring 57 are overridden by the latter so that control element 60 returns to its OFF position of FIG. 6 wherein motor 40 is deenergized.

The cooperation of catch elements 111 and 122 retain assembly 80 in its position of FIG. 6 so that blade 90 is in engagement with the inner surface of can body 118, pin 119 rests against bead 116 and formation 21*c* rests against the outside of body 118 so that opener 20 remains mounted on can 115 after cover 117 is severed from body 118 and picked up by magnet 101. By manually pivoting assembly 80 counterclockwise from its position of FIG. 1 until blade tip 122 is above bead 116, opener 20 can be dismounted from can 115.

Although the present invention has been described in connection with a preferred embodiment thereof, many variations will now become apparent to those skilled in the art. It is preferred, therefore, that the present invention be limited not by the specific disclosure herein, but only by the appended claims.

What is claimed is:

1. A power driven can opener including:

a housing, a driving means supported by said housing and engageable with a head surrounding a can cover, an electric motor within said housing for operating said driving means, a cutter assembly including blade means for cutting a can cover to remove same from a can body;

means mounting said assembly for movement relative to said housing between a first position wherein said blade means is remote from a can engaged by said driving means and a second position wherein said blade means engages a can in operative engagement with said driving means;

catch means for releaseably limiting motion of said assembly relative to said housing from said second position to a third position which is between said first and second positions, said third position being in close proximity to said second position, and with said assembly in said third position said blade means engaging a can in operative engagement with said driving means;

with said assembly in said second and third positions said blade means and said driving means cooperating to hold a can operatively mounted with said can opener;

switch means manually operable to a closed position for energizing said motor, and biasing means urging said switch means toward an open position;

latch means for maintaining said switch means in said closed position, said latch means being mounted to said housing for movement between a first and second position relative thereto, said latch means when in its said first position permitting said biasing means to open said switch means, said latch means when in its said second position being disposed to retain said switch means closed;

said assembly including a formation which, when said assembly is in its said second position, operates said latch means to its said second position;

said assembly being moved from its said third position to its said second position and being retained thereat by reaction forces generated by a wedging action between a can and said blade means while the latter is cutting a can top.

2. A can opener as set forth in claim 1 also including battery means for energizing said motor, said battery means being disposed within said housing and being connected in circuit with said motor and said switch means.

3. A can opener as set forth in claim 2 in which said can opener is supported solely by a can while its top is being cut by said blade means.

4. A can opener as set forth in claim 1 in which said switch means includes a manually operable control remote from said cutter assembly for selectively closing said switch means.

5. A can opener as set forth in claim 4 also including battery means for energizing said motor, said battery means being disposed within said housing and being connected in circuit with said motor and said switch means.

6. A can opener as set forth in claim 5 in which the driving means is disposed outside of said housing in front of a front wall thereof; said switch means including contact means disposed within said housing; speed reduction gear means disposed within said housing; said gear means having an input driven by said motor and having an output which drives said driving means.

7. A can opener as set forth in claim 6 in which the housing means also includes a rear wall having an openable cover through which said battery means is removed and inserted.

8. A can opener as set forth in claim 7 in which said driving means comprises a drive wheel mounted on a first axis that is transverse to said front wall; said motor having an output shaft that is generally parallel to said front wall.

9. A can opener as set forth in claim 1 in which the cutter assembly includes a spring that biases said blade means toward piercing a cover of a can in operative engagement with said driving means; said spring also downwardly biasing a cover of a can in operative engagement with said driving means.

* * * * *